United States Patent [19]

Kucher et al.

[11] 4,109,598

[45] Aug. 29, 1978

[54] METHOD OF MAKING A UNITARY FRAME FOR A WINCH

[76] Inventors: Robert C. Kucher, 5200 Airport Way South, Seattle, Wash. 98108; Terence W. Dahl, 6117-183rd Pl. Southwest, Lynnwood, Wash. 98036

[21] Appl. No.: 589,588

[22] Filed: Jun. 23, 1975

Related U.S. Application Data

[62] Division of Ser. No. 251,218, May 8, 1972, abandoned.

[51] Int. Cl.[2] ..... B21D 53/00

[52] U.S. Cl. ..... 113/116 HH; 29/150; 72/379; 113/116 HA

[58] Field of Search ..... 29/150, 522; 113/116 HA, 116 HH, 116 Y; 72/379, 702; 254/145

[56] References Cited

U.S. PATENT DOCUMENTS

| | | | |
|---|---|---|---|
| D. 135,425 | 4/1943 | McLaren | 113/116 HH |
| 828,488 | 8/1906 | Lanz | 29/150 |
| 1,593,783 | 7/1926 | Stresan | 29/150 |
| 1,740,253 | 12/1929 | Lock | 29/522 |
| 2,314,038 | 3/1943 | Elting | 113/116 HH |
| 3,122,194 | 2/1964 | Bronson et al. | 72/705 |
| 3,554,150 | 1/1971 | Goetsching et al. | 72/368 |
| 3,807,040 | 4/1974 | Otto | 29/522 |

*Primary Examiner*—Carl E. Hall
*Attorney, Agent, or Firm*—Thomas W. Secrest

[57] ABSTRACT

This invention is for a unitary frame for a winch and the method for making said unitary frame.

The frame is made from relatively thick metal, such as steel and the various alloys of steel, and is at least about 3/16 inch thick.

The frame comprises a base and two spaced-apart upright sides.

4 Claims, 7 Drawing Figures

METHOD OF MAKING A UNITARY FRAME FOR A WINCH

This application is a divisional application of my co-pending application, Ser. No. 251,218, filing date of May 8, 1972, now abandoned.

In the past, a frame for a winch comprising a drum has been a fabricated frame. With a relatively thick metal, such as a metal having a thickness of 3/16 inch or greater, it has been necessary to fabricate the frame to make an integral frame. For example, the frame comprises a base and two spaced apart upright sides. The two sides have been welded to the base. Generally, the welding has been done with manual labor. Then, the excess weld has been ground off the frame so as to give a more pleasing and safer surface to the frame where the base and the sides connect. In the manufacture of this frame, considerable manual labor has been used to weld the sides and the base and also to grind off the excess weld and metal. To the best of our knowledge, prior to this invention, frames for winches and drums and the like, said frames having a thickness greater than about 3/16 inch, have been fabricated frames and welded into an integral frame.

In a fabricated frame, the welds are weaker than the metal. Further, if the frame is used outdoors and around the waterfront, the welds can be corroded and, possibly, in time, rust and give way.

With this background and having worked with winches and made winches, we have developed a frame for a winch and which frame is of a unitary construction. The start of the frame can be of, at least, 3/16 inch thickness. This flat piece of steel is worked to form the unitary frame for the winch and which frame has a base and two spaced apart upright sides. In the manufacture of this frame, it is not necessary to weld parts and to also grind the weld to make the frame more acceptable. First, the frame is unitary and not integral. Secondly, being unitary, and not integral, the frame has no welds. Therefore, there is a saving in manual labor, time and cost in the making of a unitary frame as contrasted in the fabricating of a frame from separate pieces of material.

With this background an object of this invention is to provide a frame of a unitary construction and which frame is made of material relatively thick; to provide a frame which is made with a minimum of manual labor; to provide a frame which can be made with a high percentage of machine labor or automatic labor; to provide a frame of unitary construction and which frame is stronger than a fabricated frame of welded construction; to provide a method for making a frame and which method requires less time to make the frame than for a welded frame; and, to provide a frame which is less expensive to manufacture than a frame of welded construction.

These and other important objects and advantages of the invention will be more particularly brought forth upon reference to the accompanying drawings, the detailed description of the invention and the claims.

IN THE DRAWINGS

Figure 1:
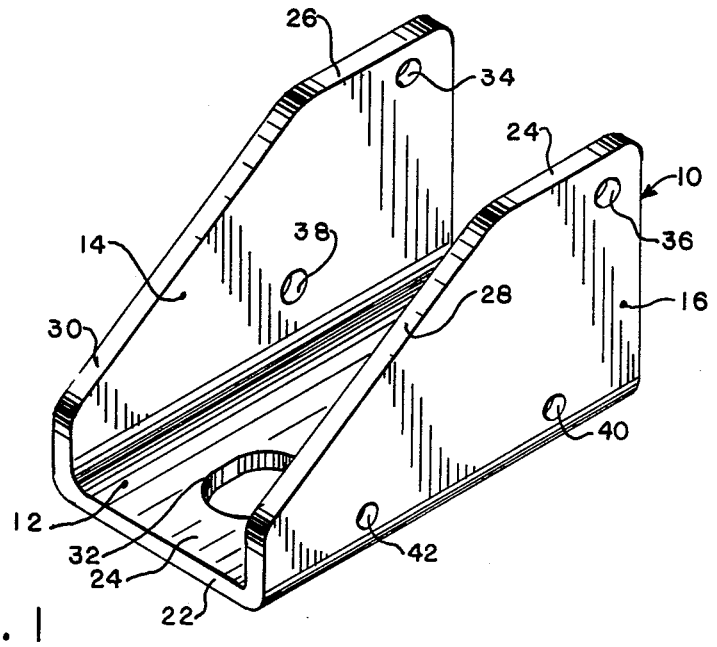
FIG. 1 is a perspective view looking at the complete frame and shows the base, and the two spaced-apart upright sides.

With reference to FIG. 1 it is seen that there is illustrated a frame 10 comprising a base 12 and two spaced-apart upright sides 14 and 16.

In FIG. 1 it is seen that the sides 14 and 16 are substantially parallel and, also, are substantially at right angles to the base 12.

Figure 2:
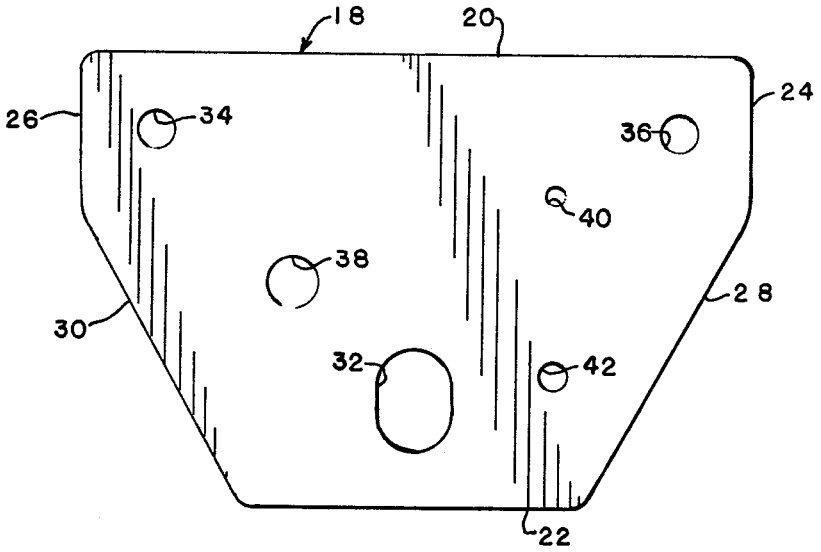
FIG. 2 is a plan view of a blank of steel plate, or other appropriate metal, and from which blank the frame is manufactured.

In FIG. 2 it is seen that there is a substantially flat plate or blank 18. The plate or blank 18 may be considered to be, in the plan view, of a modified trapezoidal configuration having a long end 20 and a short end 22. The ends 20 and 22 are substantially parallel. Then, on the outside of the end 20 there are two short sides 24 and 26. The short sides 24 and 26 are substantially parallel. Then, the short side connects with the short end 22 by means of a diagonal 28, and the short side 26 connects by means of a diagonal 30 with the short end 22.

The substantially flat plate or blank 18 is at least 3/16 of an inch thick and comprises a steel plate or alloys of steel.

It is seen that in the blank 18 there is a hole or passageway 32. The hole or passageway 32 is of a generally elliptical configuration or of an elongated circle.

Further, near the short edge 26 there is a hole or passageway 34 and near the short edge 24 there is a hole or passageway 36. There is a hole or passageway 38 between the holes or passageway 32 and 34. Further, between the holes and passageways 32 and 36 there are two holes or passageways 40 and 42.

Figure 3:
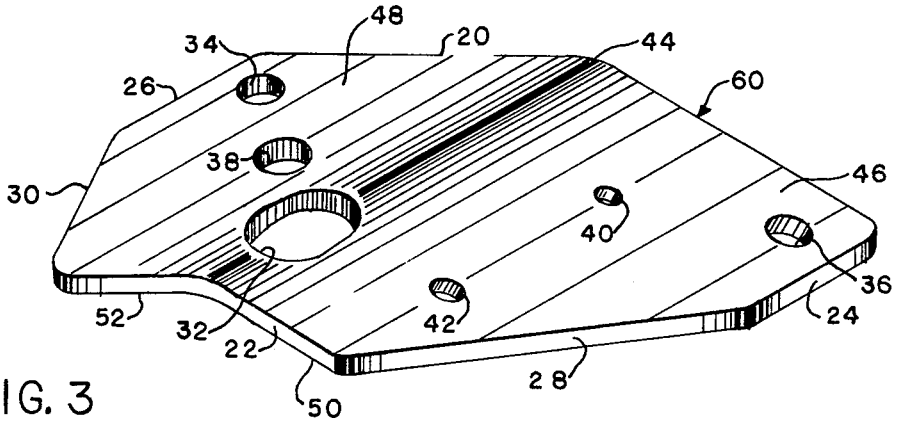
FIG. 3 is a perspective view looking at the blank of steel plate after the steel plate has been bent to form a ridge.

In FIG. 3 there is illustrated the blank 18, after it has been worked so as to have a longitudinal ridge 44. The longitudinal ridge runs from the long end 20 to the short end 22, and also passes through the passageway 32.

With the bending of the plate 18 to define a ridge 44 it is seen that there is produced a first outer surface 46, a second outer surface 48, a first inner surface 50 and a second inner surface 52.

The first outer surface 46 and the first inner surface 50 are on that side of the ridge having the holes or passageways 36,40 and 42. The second outer surface 48 and the second inner surface 52 are on that side of the ridge 44 having holes or passageways 34 and 38.

Figure 4:
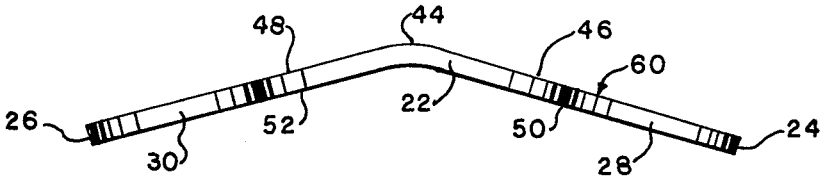
FIG. 4 is an end elevational view of the blank of FIG. 3 and shows the blank of a V-shape.

In FIG. 4, an end elevation view of FIG. 3, it is seen that the plate 18 has now assumed the configuration of an inverted V-shape, identified by reference numeral 60.

The V-shape 60 is further worked so as to bend upwardly the outer edges of the first outer surface 46 and the second outer surface 48.

Figure 5:
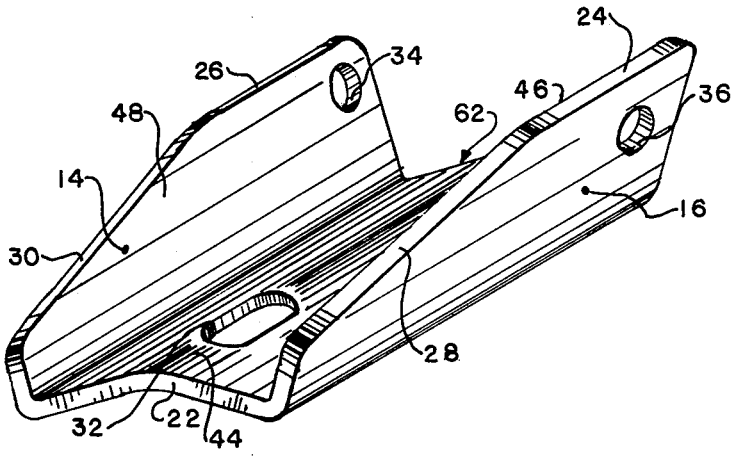
FIG. 5 is a perspective view looking at the frame while it is being formed and shows the outer edges being bent upwardly so as to overlie each other and also shows the ridge.

The V-shape 60 is further worked to form the intermediate shape 62, see FIG. 5. In 62 the outer part of the first outer surface 46 has been worked or bent so as to overlie the inner part of the first outer surface 46 and to project upwardly as the ridge 44 projects upwardly. Similarly, the outer part of the second outer surface 48 is worked to overlie the inner part of said second outer surface and to project upwardly in a direction as the ridge 44 projects upwardly. In an end elevation view the worked material assumes the shape 62, a W-shape.

Figure 6:
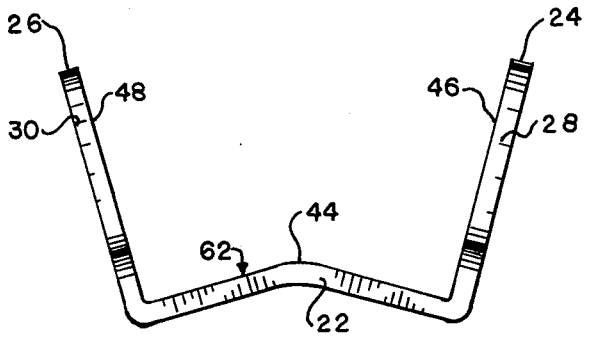
FIG. 6 is an end elevational view of FIG. 5 and illustrates the frame, at this stage of formation, in a generally W-shape; and, FIG. 7 is an end elevational view of the frame of FIG. 1 and illustrates the base and the two upright sides and the frame being in a U-shape.

In FIG. 6, an end elevation view, it is seen that the object 62 has a W-shape.

Then, the ridge 44 is depressed so that the inner parts of the first outer surface 46 and the second outer surface 48 are made to be substantially flat and a substantially continuous surface identified as the base 64. In FIGS. 5 and 6 it is seen that if the ridge is forced so as to become essentially flat and the surface to be a substantially continuous flat surface that the sides 14 and 16 will rotate inwardly toward each other. With the rotation of the sides 14 and 16 inwardly towards each other there results the frame 10. The frame 10 has the two spaced-apart upright sides 14 and 16 and the base 24. The sides 14 and 16 are continuous with the base 64. Also, the upright sides 14 and 16 are substantially parallel and substantially at right angles to the the base 64.

Figure 7:
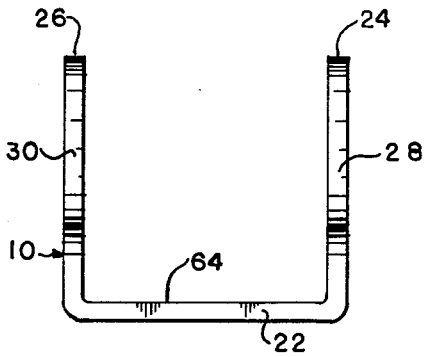

In FIG. 7, an end elevational view of the frame 10, it is seen that the frame 10 has a generally U-shape.

From the foregoing it is seen that we have provided a method for making a unitary frame for a winch. The unitary frame for the winch is made from a substantially flat plate or substantially flat piece of steel or an alloy of steel relatively thick, at least 3/16 of an inch thick. We have actually made a frame 10 from a steel plate 18 having a thickness of $\frac{5}{8}$ inch. We consider that the method of manufacture of this unitary frame is less expensive than for a fabricated frame, fabricated from three pieces and welded into an integral frame. Also, we consider that less time is expended because it is not necessary to manually weld the three pieces into an integral frame and it is not necessary to grind the excess weld to give a more finished appearance. In fact, the frame 10 we have manufactured has a finished appearance because it is a continuous frame without rough edges or welds which have been ground to be more presentable. Further, we consider the frame 10, because of its unitary structure, to be stronger than a fabricated frame or an integral frame. There are no welds to receive moisture, or if working around salt water, to receive a salt spray, and to corrode, rust and become weak.

In the manufacture of the frame 10, it is seen that the holes or passageways 34 and 36, see FIG. 1, are aligned for receiving a shaft or bearings for a shaft of a drum.

We consider that this invention has particular merit with a frame of a U-shape where the length of the upright sides, i.e., the distance from the base 22 to the edge 24 or to the edge 26, is greater than the distance between them, i.e., the width of the base 22. With this type of frame it is not possible to make the frame on a brake becuase the first side would get in the way upon attempting to make the second brake for the second side. For this reason a frame of U-shape with these dimensions has been fabricated from three separate pieces into an integral frame. Also, for this reason we feel that the method and apparatus which we have evolved is new and useful and has unique advantages, as previously outlined.

From the foregoing description and discussion of our invention for a unitary frame 10, what we claim is the frame itself and the method for making said frame.

We claim:

1. A method for making a frame for an apparatus, said frame comprising:

a. a base;

b. a first side;

c. a second side;

d. said first and said second sides projecting outwardly from said base;

e. said frame being a unitary structure and of a thickness of at least 3/16 inch;

f. said method comprising forming a piece of metal to have a ridge, a first outer surface, a second outer surface, a first inner surface and a second inner surface, and in an elevation view presenting a configuration of a V-shaped piece of metal;

g. working said V-shaped piece of metal to form the outer part of said first outer surface to be adjacent the inner part of said first outer surface, and to form the outer part of said second outer surface to be adjacent the inner part of said second outer surface, and in an elevation view presenting a configuration of a W-shaped piece of metal; and, h. working said W-shaped piece of metal to, substantially, remove said ridge with the inner part of said first outer surface and inner part of said second outer surface being, substantially, a continuous surface and defined as a base and, said first outer surface becoming the surface of said first side and said second outer surface becoming the surface of said second side.

2. A method according to claim 1 and comprising:

a. in working said W-shaped piece of metal positioning said first side, substantially, at a right angle to said base, and positioning said second side, substantially, at a right angle to said base, so that said frame, in an elevation view, presents a U-shape.

3. A method according to claim 1 and comprising:

a. in working said piece of metal, making said first side longer than the distance between said first side and said second side.

4. A method according to claim 1 and comprising:

a. in working said piece of metal, making said first side longer and said second side longer than the distance between said first side and said second side.

* * * * *